US012336674B2

(12) United States Patent
Choat et al.

(10) Patent No.: US 12,336,674 B2
(45) Date of Patent: Jun. 24, 2025

(54) SOAP DISH FOR OUTDOOR FAUCET

(71) Applicants: Daniel Choat, Granbury, TX (US); Tommy Lavene, Granbury, TX (US)

(72) Inventors: Daniel Choat, Granbury, TX (US); Tommy Lavene, Granbury, TX (US)

( * ) Notice: Subject to any disclaimer, the term of this patent is extended or adjusted under 35 U.S.C. 154(b) by 186 days.

(21) Appl. No.: 18/112,562

(22) Filed: Feb. 22, 2023

(65) Prior Publication Data

US 2024/0277189 A1 Aug. 22, 2024

(51) Int. Cl.
*A61J 9/06* (2006.01)
*A47K 5/03* (2006.01)

(52) U.S. Cl.
CPC ..... *A47K 5/03* (2013.01)

(58) Field of Classification Search
CPC ..... A61J 9/0661; A61J 9/0692; A47K 5/03
USPC ..... 211/119; 248/218.1, 302, 107, 104, 318
See application file for complete search history.

(56) References Cited

U.S. PATENT DOCUMENTS 1,951,642 A * 3/1934 Augustin ..... A01G 9/026 47/72
2,390,874 A 12/1945 Endebrock
2,596,675 A 5/1952 Giossi
3,059,374 A 10/1962 Bernay
3,140,557 A 7/1964 Albrycht
3,867,788 A * 2/1975 Mickelson ..... A47G 7/047 248/318
3,923,162 A 12/1975 Hussey
4,147,320 A * 4/1979 Biedebach ..... A47G 7/047 248/318
4,570,575 A * 2/1986 Hinz ..... A01K 39/012 119/52.2
5,377,367 A 1/1995 Bischoff
D384,847 S 10/1997 von Buelow
D788,383 S * 5/2017 Donegan ..... D30/127
11,197,585 B1 * 12/2021 Podemska-Mikluch ..... A47K 1/04
2002/0092817 A1 * 7/2002 Lamb ..... A47K 3/281 211/119
2006/0060742 A1 * 3/2006 Kumar ..... A47K 5/03 248/318
2007/0012822 A1 * 1/2007 Bellamy-Noseworthy ..... A61J 9/0638 248/104
2018/0055019 A1 * 3/2018 Kunnumpurath .... A01K 39/012
2018/0216327 A1 * 8/2018 Dudek ..... E03D 1/003

FOREIGN PATENT DOCUMENTS

EP 597383 11/1993

* cited by examiner

*Primary Examiner* — Stephen J Castellano

(57) ABSTRACT

A soap dish apparatus for hanging soap from an outside faucet or pipe includes a container with a base wall and a perimeter wall. The perimeter wall extends upwardly from the base wall. The base wall and the perimeter wall define a cavity in the container for retaining soap. The perimeter wall has an open top and a rim surrounding the open top. The base wall has an aperture extending through the base wall into the container. A wire is coupled to the container for hanging the container on a faucet. The wire is coupled to the container at a back portion of the perimeter wall.

15 Claims, 6 Drawing Sheets

SOAP DISH FOR OUTDOOR FAUCET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to soap dishes and more particularly pertains to a new soap dish for hanging soap from an outside faucet or pipe.

(2) Description of Related Art Including Information Disclosed Under 37 CFR 1.97 and 1.98

The prior art relates to myriad soap dishes which hold soap and hang from a shower head or shower curtain rod. The soap dishes of the prior art comprise rigid hooks or flanges for attachment to the shower hear or curtain road. However, the prior art does not disclose a wire attached to the back of a container of a soap dish for hanging from an outside faucet and a drain hole extending through a base wall of the container for draining water.

BRIEF SUMMARY OF THE INVENTION

An embodiment of the disclosure meets the needs presented above by generally comprising a container with a base wall and a perimeter wall. The perimeter wall extends upwardly from the base wall. The base wall and the perimeter wall define a cavity in the container for retaining soap. The perimeter wall has an open top and a rim surrounding the open top. The base wall has an aperture extending through the base wall into the container. A wire is coupled to the container for hanging the container on a faucet. The wire is coupled to the container at a back portion of the perimeter wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
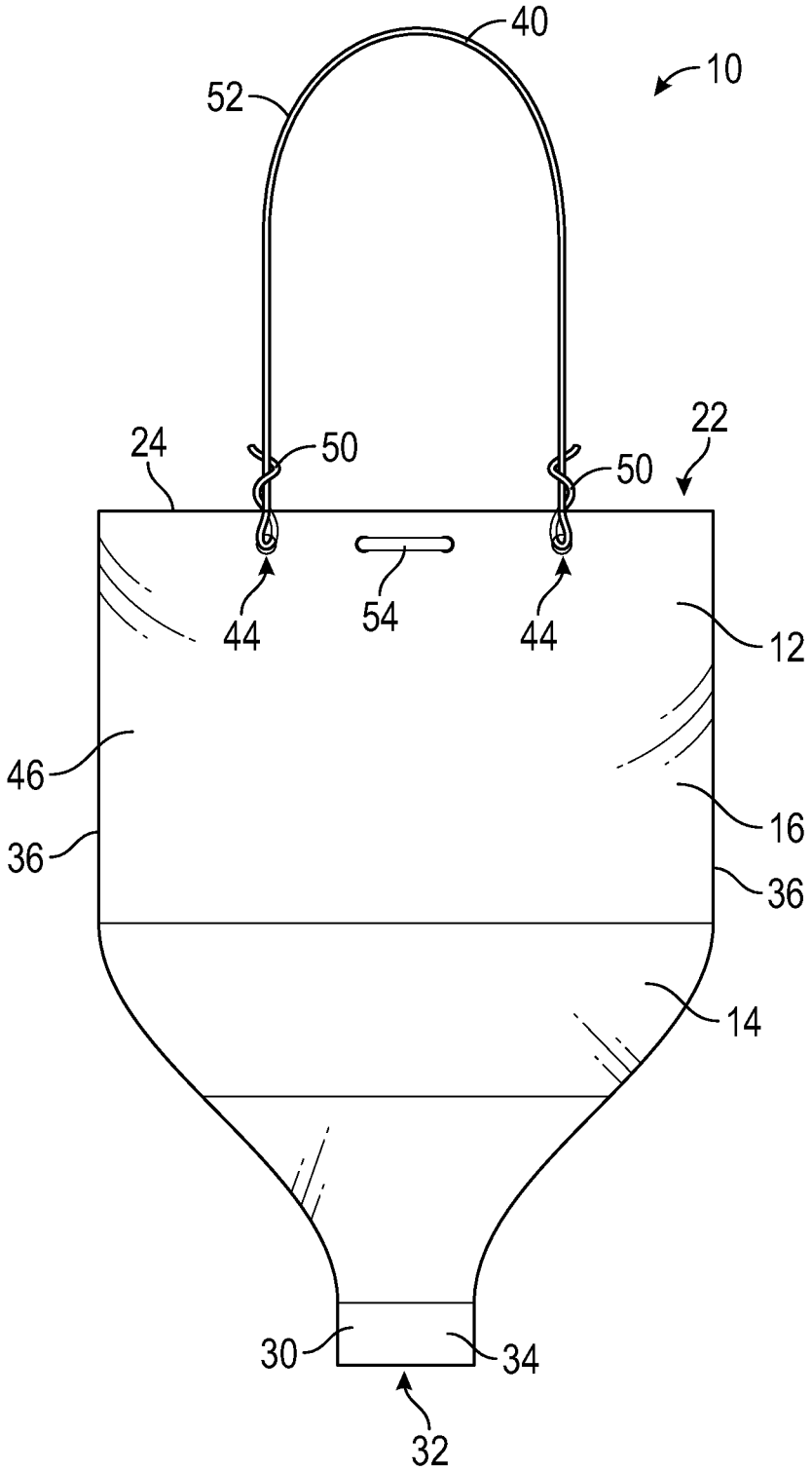
FIG. 1 is a front view of a soap dish apparatus according to a first embodiment of the disclosure.
Figure 2:
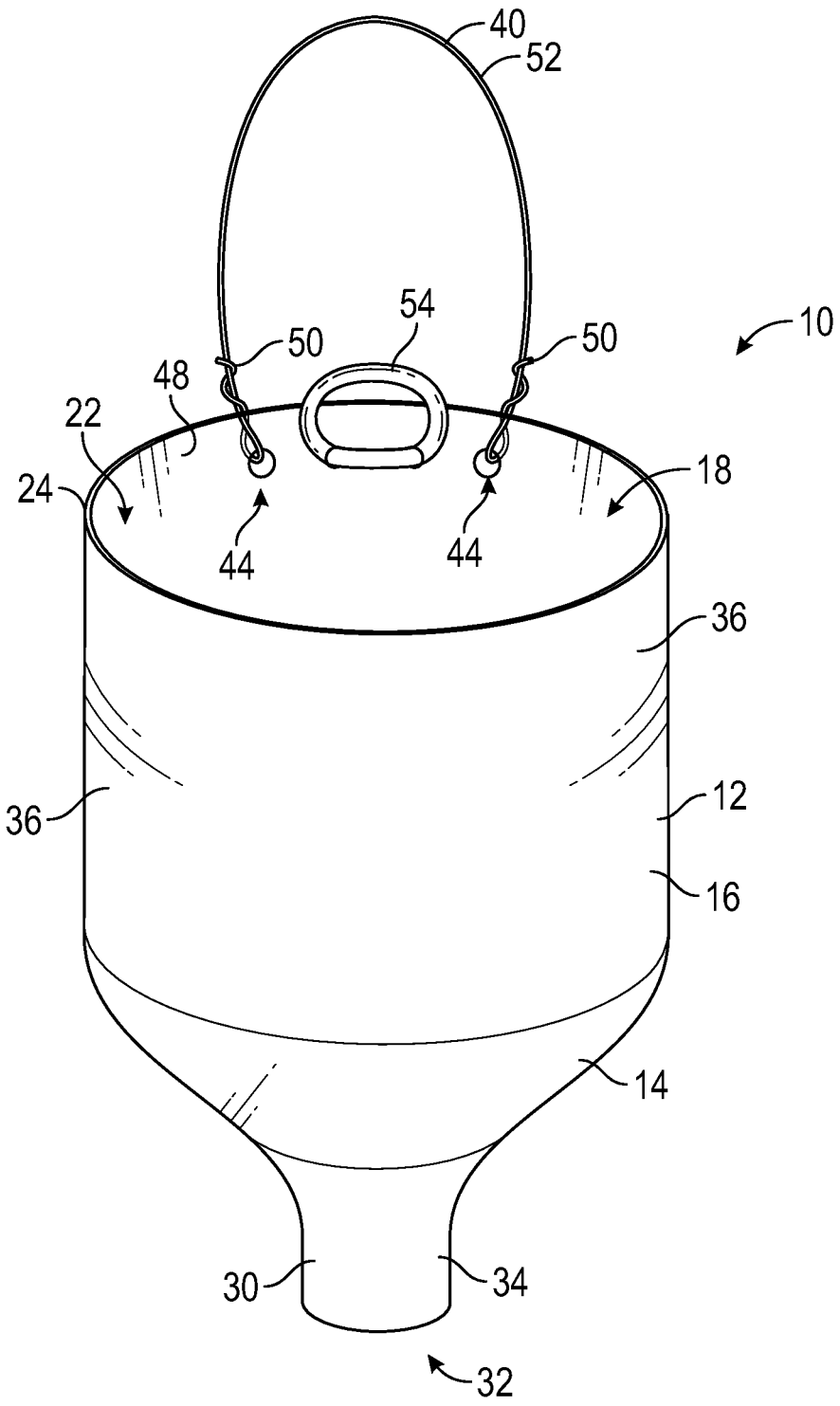
FIG. 2 is a top front perspective view of a first embodiment of the disclosure.
Figure 3:
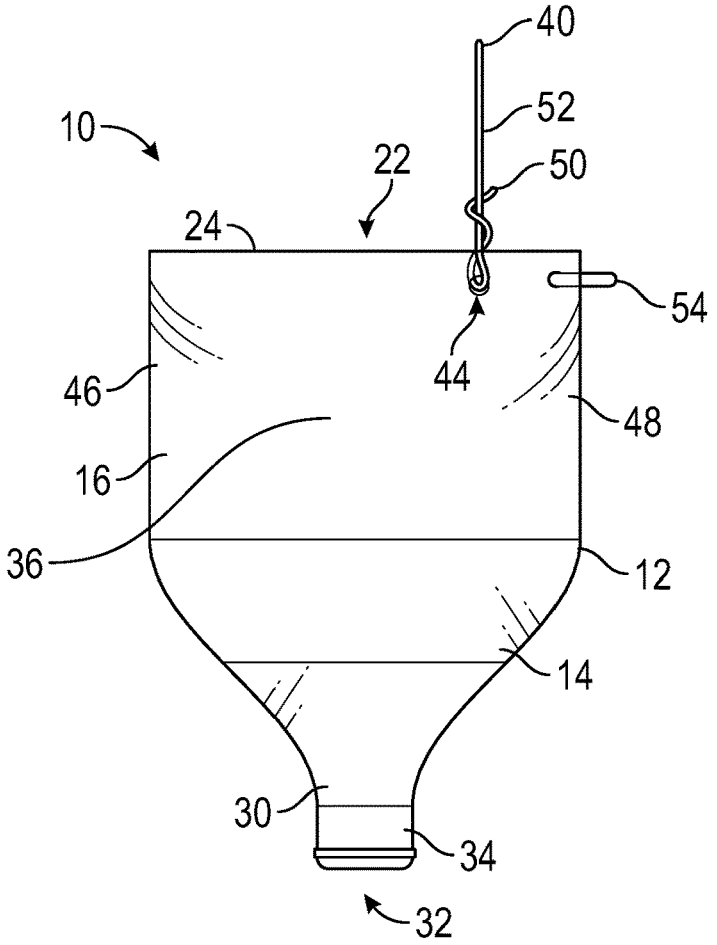
FIG. 3 is a side view of a first embodiment of the disclosure.
Figure 4:
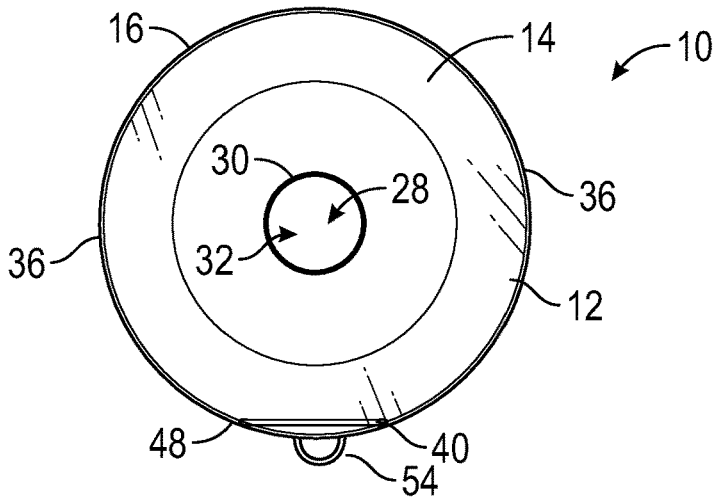
FIG. 4 is a bottom view of a first embodiment of the disclosure.
Figure 5:
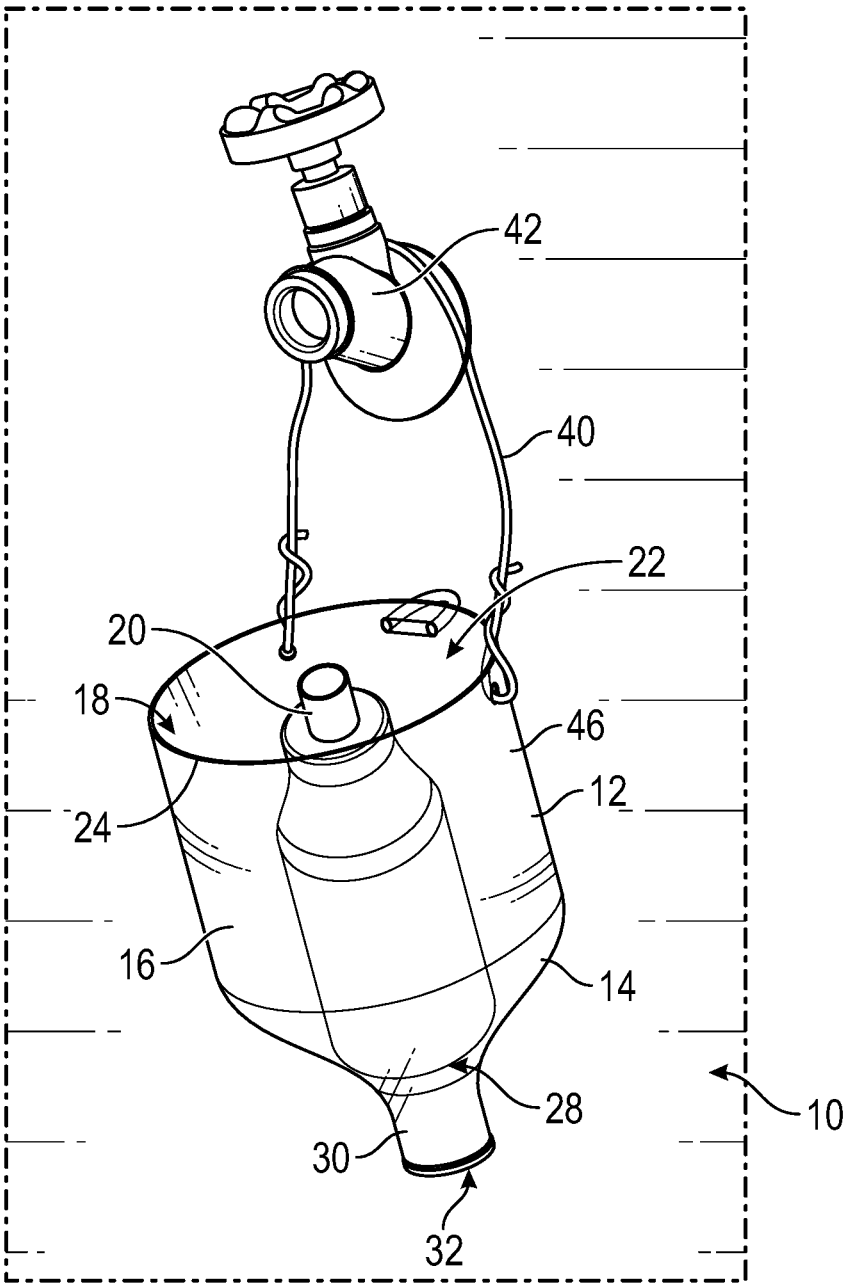
FIG. 5 is an in-use view of a first embodiment of the disclosure.
Figure 6:
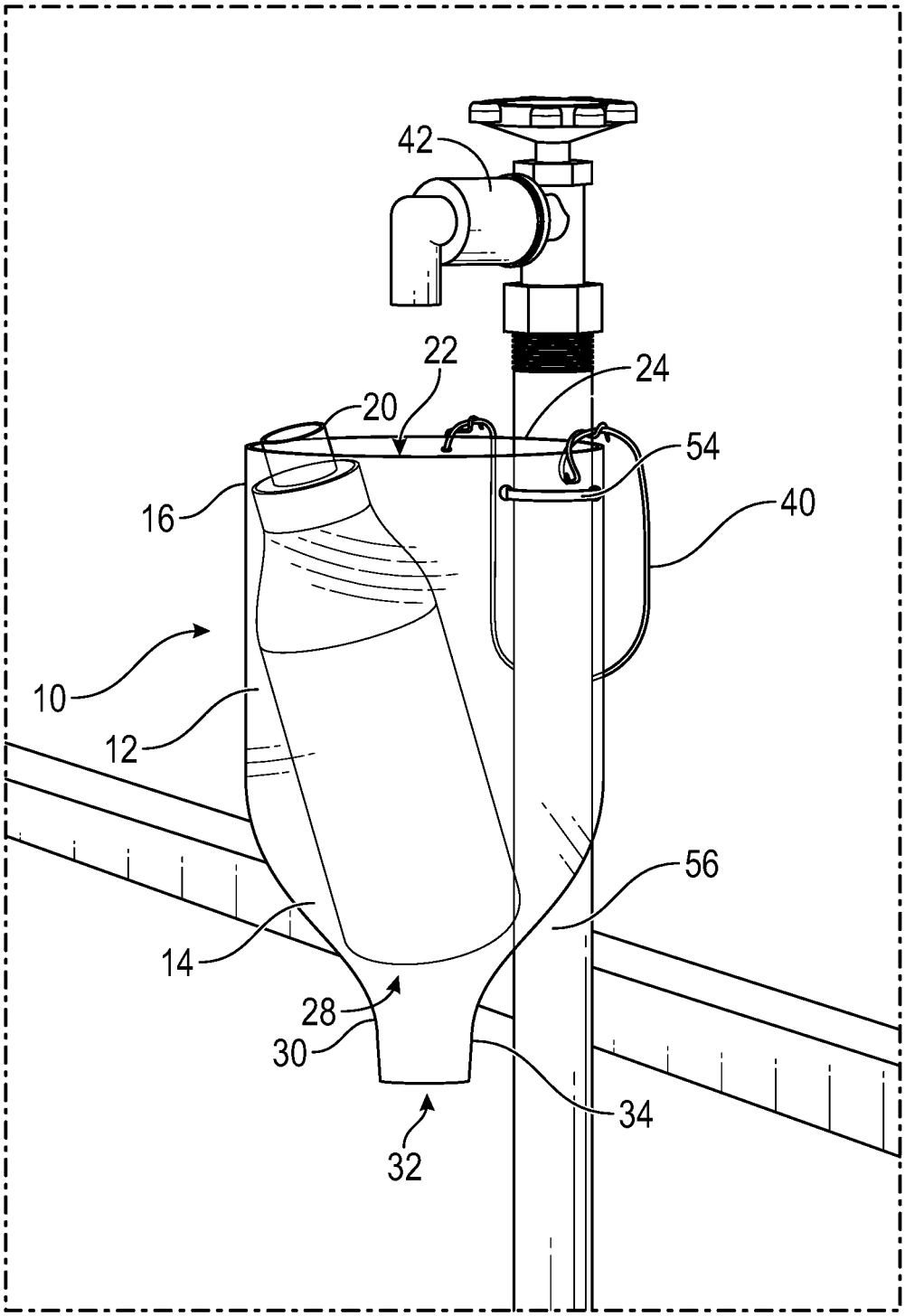
FIG. 6 is an in-use view of a first embodiment of the disclosure.

With reference now to the drawings, and in particular to FIGS. 1 through 7 thereof, a new soap dish embodying the principles and concepts of an embodiment of the disclosure and generally designated by the reference numeral 10 will be described.

As best illustrated in FIGS. 1 through 7, the soap dish apparatus 10 generally comprises a container 12 with a base wall 14 and a perimeter wall 16. The perimeter wall 16 extends upwardly from the base wall 14. The base wall 14 and the perimeter wall 16 define a cavity 18 in the container 12 for retaining soap 20, such as a bar of soap 20 or a bottle of liquid soap 20. The perimeter wall 16 has an open top 22 and a rim 24 surrounding the open top 22. The base wall 14 has an aperture 28 extending through the base wall 14 into the container 12 and is angled downwardly from the perimeter wall 16 toward the aperture 28. The perimeter wall 16 is oriented parallel to a central axis of the perimeter wall 16 for a full length of the perimeter wall 16. The container 12 includes a tube 30 extending downwardly from the base wall 14 which is in fluid communication with the aperture 28. The tube 30 has an open bottom 32 and a cylindrical shape 34. The container 12 may be translucent and may comprise plastic. A cap may be included for removably coupling to the tube 30 to cover the open bottom 32. The cap may be threaded for coupling to the tube 30, have a biased portion for engaging a lip of the tube 30, frictionally engage the tube 30, or the like. The container 12 has a container width between a pair of lateral sides 36 of the perimeter wall 16 between 3.0 and 7.0 inches. The container 12 has a height between the open top 22 of the perimeter wall 16 and the open bottom 32 of the tube 30 of between 5.0 and 11.0 inches. The open bottom 32 of the tube 30 has a drain width of between 0.25 inches and 2.0 inches.

A wire 40 is coupled to the container 12 for hanging the container 12 on a faucet 42. The container 12 has a hole 44 extending through a back portion 48 of the container 12 which is spaced from the rim 24. The wire 40 extends through the hole 44 and engages the container 12.

FIGS. 1-6 depict a first embodiment of the present invention. The perimeter wall 16 in the first embodiment has a cylindrical shape 46. The hole 44 of the container 12 is one of a pair of holes 44 in the container 12, where each hole 44 is spaced from the rim 24 and extends through the back portion 48 of the container 12. Each hole 44 is also laterally spaced from each other. The wire 40 in this first embodiment has a pair of laterally spaced tie ends 50. Each tie end 50 extends through an associated one of the pair of holes 44 and is tied around the rim 24 such that the wire 40 defines a closed loop 52. The soap dish apparatus 10 further comprises an attachment loop 54 in the first embodiment which is coupled to the back portion 48 of the perimeter wall 16 for mounting the container 12 to a pipe 56. The attachment loop 54 extends rearwardly with respect to the container 12 and is configured for receiving and engaging the pipe 56. The attachment loop 54 is positioned between each one of the pair of tie ends 50 of the wire 40. The attachment loop 54 has a diameter that is smaller than a diameter of the closed loop 52 defined by the wire 40. The attachment loop 54 may comprise a zip tie or like member so that the diameter of the attachment loop 54 is adjustable.

Figure 7:
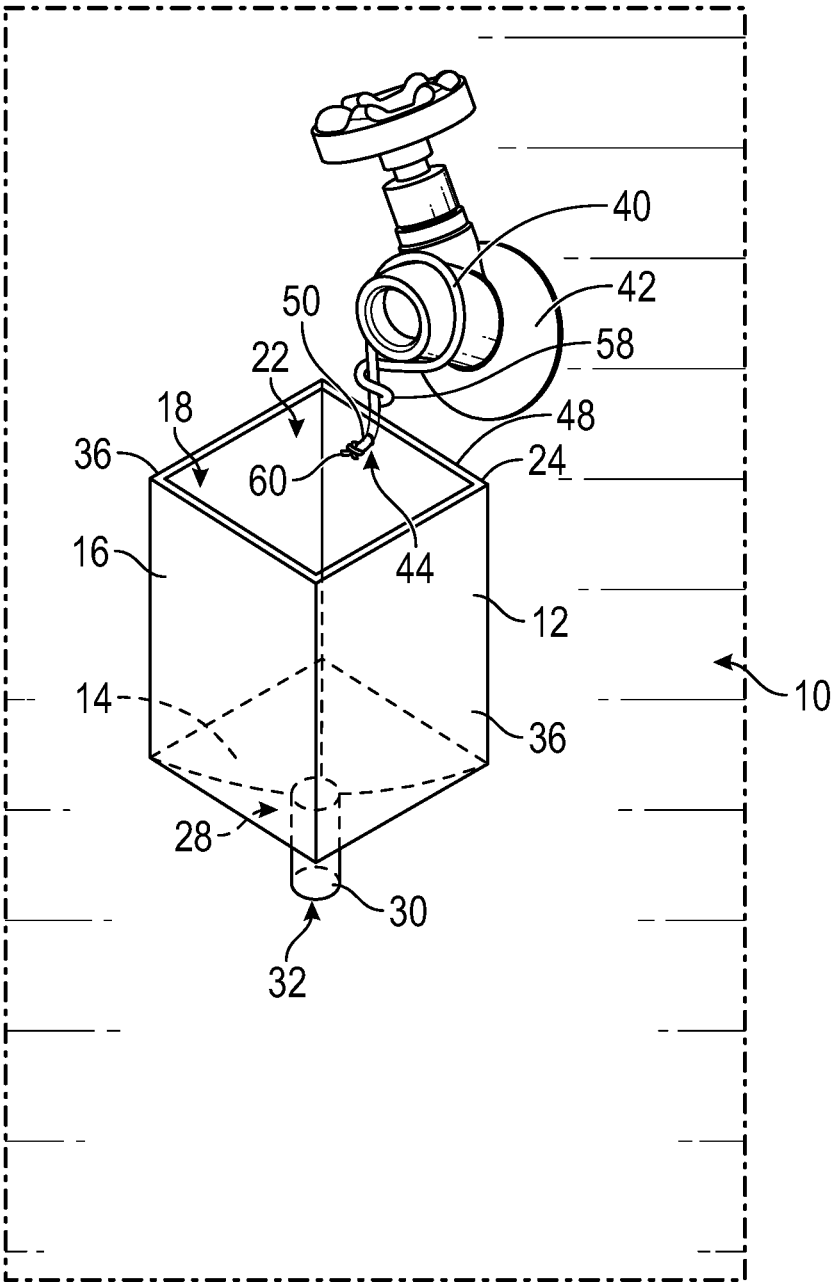
FIG. 7 is an in-use view of a second embodiment of the disclosure.

FIG. 7 depicts a second embodiment of the present invention. The perimeter wall 16 in the second embodiment has a rectangular cross section taken along a horizontal plane. And the wire 40 has a tie end 50 which extends through the hole 44 to engagingly couple to the container 12 and a free end 58 for tying the wire 40 around the faucet 42. The tie end 50 may have a knot 60 or may otherwise widen such that the wire 40 does not become removed from the hole 44.

In use, the soap dish apparatus 10 is either hung on the faucet 42 by the wire 40 or attached to the pipe 56 via the attachment loop 54. The soap 20 is stored in the cavity 18 of the container 12. If water from the faucet 42 or elsewhere enters the container 12, it drains out of the container 12 through the tube 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A soap dish apparatus comprising:

a container having a base wall and a perimeter wall, said perimeter wall extending upwardly from said base wall, said base wall and said perimeter wall defining a cavity in said container for retaining a soap, said perimeter wall having an open top and a rim surrounding said open top, said base wall having an aperture extending through said base wall into said container;

a wire being coupled to said container for hanging said container on a faucet, said wire being coupled to said container at a back portion of said perimeter wall;

a pair of holes, each said hole being spaced from said rim and extending through said back portion of said container, each said hole being laterally spaced from each other, said wire having a pair of laterally spaced tie ends, each tie end extending through an associated one of said pair of holes and being tied around said rim; and an attachment loop being coupled to said back portion of said perimeter wall for mounting said container to a pipe, said attachment loop extending rearwardly with respect to said container, said attachment loop being configured for receiving and engaging the pipe, said attachment loop being positioned between each one of said pair of tie ends of said wire.

2. The apparatus of claim 1, wherein said base wall is angled downwardly from said perimeter wall toward said aperture, said perimeter wall being oriented parallel to a central axis of said perimeter wall for a full length of said perimeter wall.

3. The apparatus of claim 1, wherein said container includes a tube extending downwardly from said base wall and being in fluid communication with said aperture, said tube having an open bottom.

4. The apparatus of claim 3, wherein said tube has a cylindrical shape.

5. The apparatus of claim 3, wherein said container has a height between said open top of said perimeter wall and said open bottom of said tube of between 5.0 and 11.0 inches.

6. The apparatus of claim 3, wherein said open bottom of said tube has a drain width of between 0.25 inches and 2.0 inches.

7. The apparatus of claim 1, wherein said container is translucent.

8. The apparatus of claim 1, wherein said container has a maximum container width between an opposed pair of lateral sides of said perimeter wall between 3.0 and 7.0 inches.

9. The apparatus of claim 1, wherein said perimeter wall has a cylindrical shape.

10. The apparatus of claim 1, further comprising an attachment loop being coupled to said back portion of said perimeter wall for mounting said container to a pipe, said attachment loop extending rearwardly with respect to said container, said attachment loop being configured for receiving and engaging the pipe.

11. The apparatus of claim 1, wherein said attachment loop has a diameter being smaller than width between said pair of holes.

12. The apparatus of claim 1, wherein said perimeter wall has a rectangular cross section taken along a horizontal plane, said wire having a tie end being coupled to said container and a free end for tying said wire around said faucet.

13. A soap dish apparatus comprising:

a container having a base wall and a perimeter wall, said perimeter wall extending upwardly from said base wall, said base wall and said perimeter wall defining a cavity in said container for retaining a soap, said perimeter wall having an open top and a rim surrounding said open top, said base wall having an aperture extending through said base wall into said container, said base wall being angled downwardly from said perimeter wall toward said aperture, said perimeter wall being oriented parallel to a central axis of said perimeter wall for a full length of said perimeter wall, said container including a tube extending downwardly from said base wall and being in fluid communication with said aperture, said tube having an open bottom, said tube having a cylindrical shape, said container being translucent, said container having a maximum container width between an opposed pair of lateral sides of said perimeter wall between 3.0 and 7.0 inches, said container having a height between said open top of said perimeter wall and said open bottom of said tube of between 5.0 and 11.0 inches, said open bottom of said tube having a drain width of between 0.25 inches and 2.0 inches; and a wire being coupled to said container for hanging said container on a faucet, said wire being coupled to said container at a back portion of said perimeter wall, said container having a hole being spaced from said rim and extending through said back portion, said wire extending through said hole and engaging said container.

14. The apparatus of claim 13, wherein said perimeter wall has a cylindrical shape, said hole of said container being one of a pair of holes, each said hole being spaced from said rim and extending through said back portion of said container, each said hole being laterally spaced from each other, said wire having a pair of laterally spaced tie ends, each tie end extending through an associated one of said pair of holes and being tied around said rim, said apparatus further comprising an attachment loop being coupled to said back portion of said perimeter wall for mounting said container to a pipe, said attachment loop extending rearwardly with respect to said container, said attachment loop being configured for receiving and engaging the pipe, said attachment loop being positioned between each of said pair of tie ends of said wire, said attachment loop having a diameter being smaller than width between said pair of holes.

15. The apparatus of claim 13, wherein said perimeter wall has a rectangular cross section taken along a horizontal plane, said wire having a tie end being coupled to said container and a free end for tying said wire around said faucet.

* * * * *